US006582538B1

(12) United States Patent
Inoue et al.

(10) Patent No.: US 6,582,538 B1
(45) Date of Patent: Jun. 24, 2003

(54) METHOD FOR PRODUCING AN AMORPHOUS ALLOY HAVING EXCELLENT STRENGTH

(75) Inventors: Akihisa Inoue, Sendai (JP); Tao Zhang, Sendai (JP); Nobuyuki Nishiyama, Sendai (JP)

(73) Assignee: Japan Science and Technology Corporation, Kawaguchi (JP)

( * ) Notice: Subject to any disclaimer, the term of this patent is extended or adjusted under 35 U.S.C. 154(b) by 0 days.

(21) Appl. No.: 09/486,948

(22) PCT Filed: Jun. 24, 1999

(86) PCT No.: PCT/JP99/03385

§ 371 (c)(1),
(2), (4) Date: Mar. 6, 2000

(87) PCT Pub. No.: WO00/03051

PCT Pub. Date: Jan. 20, 2000

(30) Foreign Application Priority Data

Jul. 8, 1998 (JP) ..... 10-210414

(51) Int. Cl.[7] ..... C22C 45/00; B22D 17/00
(52) U.S. Cl. ..... 148/561
(58) Field of Search ..... 148/403, 304, 148/305, 561

(56) References Cited

U.S. PATENT DOCUMENTS 4,191,599 A * 3/1980 Stickels et al. ..... 148/233
5,318,641 A * 6/1994 Masumoto et al. ..... 148/403
5,395,459 A * 3/1995 Pinkerton et al. ..... 148/101
6,044,893 A * 4/2000 Taniguchi et al. ..... 164/70.1

FOREIGN PATENT DOCUMENTS

JP 06231917 A * 8/1994
JP 10296424 A * 11/1998

OTHER PUBLICATIONS

"Nitriding", Academic Press Dictionary of Science and Technology, pub. by Harcourt, http://www.harcourt.com/dictionary/def/6/9/3/5/6935700.html, accessed on Feb. 1, 2001.*
"Case Hardening", Academic Press Dictionary of Science and Technology, pub. by Harcourt, http://www.harcourt-.com/dictionary/def/1/7/7/8/177800.html, accessed on Feb. 1, 2001.*

* cited by examiner

*Primary Examiner*—Roy King
*Assistant Examiner*—Harry D. Wilkins, III
(74) *Attorney, Agent, or Firm*—Armstrong, Westerman & Hattori, LLP

(57) ABSTRACT

A molten alloy having an amorphous forming ability is pressure-solidified at a pressure exceeding one atmospheric pressure to eliminate casting defects. The cooling rate during the solidification is adjusted to disperse fine crystals having a mean crystal grain diameter of 1 nm to 50 $\mu$m and a volume percentage of 5 to 40% in an amorphous alloy ingot. In this way, a uniform residual compressive stress is imparted in the amorphous alloy ingot. Furthermore, the amorphous ingot produced by this method can be strengthened by heating it at a constant temperature rising rate to infiltrate at least one of boron, carbon, oxygen, nitrogen and fluorine from the surface of the amorphous alloy ingot in a supercooled liquid state before crystallization, to thereby precipitate a high melting point compound thereof with an element forming the amorphous alloy within the alloy ingot so as to strength the alloy.

3 Claims, No Drawings

METHOD FOR PRODUCING AN AMORPHOUS ALLOY HAVING EXCELLENT STRENGTH

FIELD OF THE INVENTION

This invention relates to an amorphous alloy having characteristics excellent in bending strength and impact strength.

TECHNICAL BACKGROUND

It has been well known that amorphous metallic materials having various shapes, such as a thin strip shape, a filament shape and a powder particle shape, can be obtained by quickly cooling a molten alloy. Since an amorphous alloy thin strip can be easily produced by a method which can attain a large cooling rate, such as a single-roll method, a dual-roll method, a rotating liquid spinning method, or the like, a number of amorphous Fe-alloy, Ni-alloy, Co-alloy, Pd-alloy, Cu-alloy, Zr-alloy and Ti-alloy have been successively obtained.

Since these amorphous alloys have industrially very important characteristics such as high corrosion resistance, high strength and the like which cannot be obtained by crystalline metallic materials, an application of these amorphous alloys in the fields of new structural materials, medical-use materials, chemical materials, or the like, has been expected.

However, according to the aforementioned manufacturing methods, amorphous alloys can only be obtained as a thin strip or a thin wire. Thus, it was difficult to form such amorphous alloys into a final product shape, resulting in an industrially limited usage.

Various studies regarding an improvement of a manufacturing efficiency of an amorphous alloy, an optimization of a composition and a manufacturing method have recently been conducted, and an amorphous alloy ingot having a size which meets the requirements of structural materials has been produced. For example, in a Zr—Al—Cu—Ni alloy, an amorphous alloy ingot having a diameter of 30 mm and a length of 50 mm has been successfully obtained (see "Materials Transactions, Japan Institute of Metals" (English version) issued on 1995, Vol.36, Item. No. 1184). In a Pd—Ni—Cu—P alloy, an amorphous alloy ingot having a diameter of 72 mm and a length of 75 mm has been successfully obtained (see "Materials Transactions, Japan Institute of Metals" (English version) issued on 1997, Vol.38, Item. No.179). These amorphous alloy ingots have tensile strength of 1700 MPa or more and Vickers hardness of 500 or more, and are expected to be used as extremely high-strength structural materials.

DISCLOSURE OF THE INVENTION

Objects to be Solved by the Invention

However, the aforementioned amorphous alloy ingots are poor in plastic workability at room temperature due to its irregular atomic structure (glass-like structure), and the bending strength and the impact strength are insufficient, resulting in poor reliability as practical structural materials. Under such circumstances, it has been desired that an amorphous alloy improved in bending strength and impact strength without causing a deterioration of high strength characteristics inherent in an amorphous structure and its producing method, are developed.

Means for Solving the Problems

To solve the above mentioned problems, the present inventors have eagerly studied for the purpose of providing a practically endurable amorphous alloy having an improved bending strength and impact strength combined with high strength characteristics inherent in an amorphous structure. As a result, the inventors have found the facts that an amorphous alloy ingot having a structure in which fine crystals are dispersed can be obtained by pressure-solidifying a molten alloy having amorphous forming ability under a pressure exceeding one atmospheric pressure and appropriately adjusting the cooling rate during the solidification, and that the resultant amorphous alloy ingot is excellent in bending strength and impact strength. Based on the above, the present invention has been completed.

Furthermore, the inventors found the facts that the bending strength and the impact strength of the above-mentioned amorphous alloy can be further improved by infiltrating an element having an atomic diameter smaller than that of a metallic element, such as boron, carbon, oxygen, nitrogen and fluorine, into the amorphous alloy from its surface to form a high melting point compound, to thereby impart a residual compressive stress continuing from the surface caused by a volume reduction at the generation of the compound. Then, the present invention has been completed.

In other words, the present invention is to provide an amorphous alloy having excellent bending strength and excellent impact strength and having a minimum thickness of 2 mm or more by pressure-solidifying an amorphous alloy having an amorphous forming ability under a pressure of more than one atmospheric pressure, and adjusting a cooling rate during the solidification to disperse fine crystals having a mean crystal grain diameter of 1 nm to 50 $\mu$m in a crystal volume percentage of 5 to 40%.

Furthermore, the present invention is also to provide an amorphous alloy having excellent bending strength and excellent impact strength in which the texture is inclined from the surface toward the inside due to a precipitation of a high melting point compound of at least one of boron, carbon, oxygen and fluorine infiltrated from the surface of the amorphous alloy ingot manufactured by the above-mentioned method with an element forming the amorphous alloy, whereby a compressive stress layer is formed in the surface of the alloy.

The above-mentioned method for producing the amorphous alloy by dispersing fine crystal grains and the strengthening method by infiltrating an element from the surface of the amorphous alloy are similar in that both the methods utilize residual stress. However, both the methods are compatible in that the stress generating portions are different and the compounds formed by the infiltrated elements protects the surface of the amorphous alloy. In addition, the bending strength and the impact strength of the amorphous alloy can be greatly improved due to the multiplier effect.

The Best Mode for Carrying out the Invention

First, a preferred embodiment concerning an alloy according to the present invention recited in claim 1 and its producing method, will now be described as follows.

In general, a cooling rate required to form an amorphous alloy (a critical cooling rate) differs depending on an alloy to be produced because of different amorphous alloy forming ability of an alloy to be produced. It is reported that the critical cooling rate of La-alloy is about 100° C./second, that of Pd-alloy is about 1.6° C./second, and that of Fe-alloy is about 10,000° C./second. As will be apparent from the above, the critical cooling rate differs depending on an alloy to be produced.

However, in all of these amorphous forming alloys, by decreasing the critical cooling rate by about 20 to 50%, an amorphous alloy in which crystals are dispersed partially can be produced. Further, in order to produce an amorphous alloy having the crystal grain diameter and the crystal volume percentage defined in the claims, it is preferable that the manufacturing apparatus can widely control the cooling rate to any desired rate. The adjustment of the cooling rate can be performed appropriately by adjusting a die heat capacity, adjusting a water flow rate or controlling a temperature of a molten alloy during the casting.

The amorphous alloy according to the present invention is formed to have a minimum thickness of 2 mm or more by the aforementioned method. If the thickness is less than 2 mm, an amorphous alloy plate can be easily produced because a cooling rate enough for producing an amorphous alloy can be obtained. However, it is difficult to produce an amorphous alloy having the crystal grain diameter and the crystal grain volume percentage recited in the claims by solidifying the molten alloy while adjusting the cooling rate decreased by 20 to 50% from the critical cooling rate of the alloy.

In the available amorphous forming alloys as of today, the maximum thickness of the amorphous alloy is 72 mm. However, in the cooling rate range at which the crystal grain diameter and the crystal volume percentage defined by the claims can be obtained, if the thickness exceeds 10 mm, large metallic compounds will precipitate in the alloy, which deteriorates the mechanical characteristics. Thus, it is preferable that the thickness of the amorphous alloy is 2 mm or more. From a view point of mechanical strength, it is preferable that the thickness is 10 mm or less.

Furthermore, in order to effectively eliminate casting defects which may cause a start point of fracture of an amorphous alloy according to the present invention, it is preferable to pressure-solidify a molten alloy. In a pressure-casting apparatus, it is effective that the applied pressure exceeds one atmospheric pressure. More preferably, the applied pressure exceeds two atmospheric pressure. If the applied pressure is not larger than one atmospheric pressure, it is impossible to crush the casting defects which will be generated during the casting. The applied pressure can be obtained preferably by a die compression method which utilizes an oil-pressure, an air-pressure, an electric-driving, or the like, and an injection casting method such as a die casting or a squeeze casting.

In the amorphous alloy according to the present invention, the mean diameter of crystal grains contained in the amorphous alloy is regulated to be 1 nm to 50 $\mu$m, and the crystal volume percentage is regulated to be 5 to 40%. This regulation is necessary and essential conditions for improving the bending strength and the impact strength which constitute the basis of the present invention. In detail, if the mean crystal grain diameter is less than 1 nm, the fine crystals do not actually function effectively so as to improve the bending strength and the impact strength. On the other hand, if it exceeds 50 $\mu$m, the largely grown crystals function as the start point of fracture. These large crystals not only deteriorate the bending strength and the impact strength, but also causes a deterioration of the high strength characteristic inherent in an amorphous alloy. More preferably, the mean crystal grain diameter falls within the range of from 100 nm to 10 $\mu$m.

There is a relationship between the crystal volume percentage and the crystal grain diameter. Generally, the crystal volume percentage decreases in accordance with the decrease of the crystal grain diameter. If the crystal volume percentage is not larger than 5%, the fine crystals will not effectively function so as to improve the bending strength and the impact strength, which is similar to the case where the mean crystal grain diameter is less than 1 nm. If the crystal volume percentage exceeds 40%, the crystals function as the start point of fracture similar to the case where the mean crystal grain diameter exceeds 50 $\mu$m, which causes a deterioration of not only the bending strength and the impact strength but also the high strength characteristic inherent in an amorphous crystal. More preferably, the crystal volume percentage falls within the range of from 10% to 30%.

The following is an explanation of the reasons why the bending strength and the impact strength of the amorphous alloy are improved by the existence of the crystal having the grain diameter and the volume percentage defined by the claims.

In a normal metal crystal, it has an easy-to-deform axis which is partially deformed easily because of its regular atomic arrangement. The strength of a crystalline metallic material is defined by the aforementioned easy-to-deform axis. However, an amorphous alloy has structural characteristics that the atomic arrangement is isotropic and disordered. Due to the structural characteristics, the amorphous alloy does not have anisotropy which is easily deformed plastically in part. Therefore, an amorphous alloy shows high strength because the alloy has no axis partially low in strength. However, having no plastically easy-to-bend axis causes a deterioration of the bending strength and the impact strength.

As taught by the present invention, in a case where crystals having a certain grain diameter and a certain volume percentage are dispersed in an amorphous alloy, these crystals function so as to decrease the inner stress caused by the external stress in the amorphous alloy. Furthermore, since the crystals contract during the solidification of the alloy, the alloy is solidified in a state that the amorphous phase around the crystals has residual compressive stress. Thus, the crystals also have effects for enhancing the strength of the amorphous phase itself.

Residual compressive stress in the amorphous alloy was estimated. The following equation (1) represents the relationship between the cubical dilation ($\epsilon\upsilon$) and the volume change ($\Delta V$) caused in a certain volume (V).

$$\epsilon\upsilon=\Delta V/V \tag{1}$$

If it is assumed that the aforementioned cubical dilation is caused by the difference between the heat expansion coefficient of the amorphous and that of the crystal by cooling, the above equation (1) can be represented by the following equation (2) utilizing the thermal expansion coefficients of the amorphous and the crystal.

$$\epsilon\upsilon=3(\alpha-\alpha')E\Delta T/(1+\alpha\Delta T) \tag{2}$$

wherein the aforementioned E denotes elastic modulus. On the other hand, the relationship between the elastic modulus (E) and the cubical dilatation ($\epsilon\upsilon$) is represented by the following equation.

$$E=\sigma/\epsilon\upsilon \tag{3}$$

Therefore, the inner stress a generated by cooling is represented by the following equation (4) from the aforementioned equations (1) to (3).

$$\sigma=3E(\alpha-\alpha')\Delta T/(1+3\alpha\Delta T) \quad (4)$$

The inner stress which generates by cooling at the temperature difference of 400K. is estimated to be approximately 1600 MPa from the following data; $\alpha=21\times10^{-6}$, $\alpha'=8\times10^{-6}$ and E=100 GPa which are actual measured data obtained through experiments. This estimated value generally corresponds to an increased amount of bending strength of the amorphous alloy in which crystal grains, which will be mentioned later, is included. Therefore, an amorphous alloy solidified in a state that crystals are included maintains a large amount of interior residual stress, and it is surmised that the interior residual stress improves the strength against bending loads and impact loads.

It is easy to obtain an amorphous alloy ingot excellent in strength against a tensile load, a bending load and an impact load by applying the above-mentioned preferable method to an alloy having a large amorphous forming ability which is possible to obtain a strip like shape, a filament shape and a particle shape by cooling the molten alloy to solidify by various methods including, for example, a single-roll method, a dual-roll method, a rotating liquid spinning method.

Next, a preferable embodiment of an alloy according to the present invention defined by claim 2 and its producing method will be explained.

In order to infiltrate an element having a smaller atomic diameter as compared to a metallic element forming an amorphous alloy, such as boron, carbon, oxygen, nitrogen or fluorine, into a surface of an amorphous alloy, it is preferable to employ a carbonizing method, a nitriding method or a boronizing method utilizing a solid, a salt bath or gases, which is employed as a heating in a gas atmosphere including the aforementioned infiltrating elements, a heat diffusion treatment after the ion implantation of these elements, or a conventional surface hardening method of a crystal alloy.

In a case where the amorphous alloy ingot has a complicated configuration of the final product, it is more preferable to employ a surface treatment method using a salt bath and gases. Furthermore, it is easy to control the thickness of the residual compressive stress layer on the surface and the texture inclination by adjusting the processing temperature and time.

For example, as shown in the embodiment mentioned below, in a material which was obtained by ion-implanting a carbon atom into a Zr-amorphous alloy, and then subjecting to a diffusion treatment for three minutes at 500° C. falling within a supercooled liquid region of the alloy, it was confirmed that γ-ZrC (the melting point is 3430° C.) was fixed on the surface of the material. It was also confirmed that the surface layer of about 100 μm thickness is gradually hardened along the thickness direction. Judging from the above, it is understood that high melting point compounds are generated in the surface portion of the amorphous alloy by the ion implantation and the diffusion treatment, and that the compounds are organically inclined from the surface toward the inside of the alloy.

The followings are explanations of the reasons why the residual compressive stress maintains in the surface of the amorphous alloy by the infiltration of the element, and the reason why the bending strength and the impact strength of the amorphous alloy are improved by the existence of the residual compressive stress.

In a normal metal crystal, it has an easy-to-deform axis which is partially deformed easily because of its regular atomic arrangement. The strength of a crystalline metallic material is defined by the aforementioned easy-to-deform axis. However, an amorphous alloy has structural characteristics that the atomic arrangement is isotropic and disordered. Due to the structural characteristics, the amorphous alloy does not have anisotropy which is easily deformed plastically in part. Therefore, an amorphous alloy shows high strength and high elastic limit characteristics because the alloy has no axis partially low in strength. However, having no plastically easy-to-bend axis causes a deterioration of the bending strength and the impact strength.

In an amorphous substance, especially in an oxide glass, by cooling the surface thereof with a wind during its solidification, residual compressive stress is maintained in the surface portion. The resultant glass has an improved mechanical strength, which is generally commercialized as a tempered glass. However, in general, since a large cooling rate is required to make an amorphous metal, it is difficult to accurately control the residual compressive stress by adjusting the cooling rate. As taught by the present invention, maintaining the residual compressive stress in the surface of the amorphous alloy gives the similar effect as the wind strengthening employed in an oxide glass.

The infiltrating element used in the present invention has an atomic diameter generally smaller than a metallic element. This implies that it is easily diffused in an amorphous alloy having a space (free volume) relatively larger than that of a crystal alloy. Some amorphous alloys transit to a supercooled liquid state before the crystallization in a heating process at a constant temperature rising rate, to thereby suddenly increase the free volume. In a crystal alloy, the infiltrating of the element concentrates near the surface of the alloy. On the other hand, in an amorphous alloy which transits to a supercooled liquid state by the transit phenomenon, the depth of the infiltration increases effectively.

On the other hand, the infiltration element generates a compound with an element forming an amorphous alloy by heating the amorphous alloy. If boron, carbon, oxygen, or nitrogen is infiltrated and diffused in a Zr-amorphous alloy, $ZrB_2$, γ-ZrC, γ-$ZrO_{2-x}$, or ZrN is generated, respectively, as the compound. Generally, these compounds have a melting point of approximately 3000° C. and hardness endurable as a tool. A compound generated by reacting to a base metal of a known amorphous alloy also has similar characteristics. These generated compounds have crystal characteristics and are condensed when being generated to reduce the volume. This volume decrease causes residual compressive stress in a portion of an amorphous alloy around the crystals.

Furthermore, it is understood that a fracture in an amorphous structure is caused by a detachment of the bond between atoms. It is said that though the bond is easily detached by tensile strength it is difficult to crush the bond by compressive stress. Furthermore, it is said that the start point of the fracture of the bond is a stress concentration portion near a surface crack (see "Invitation to glass," written by Tsutomu Minami, published by Sangyo Tosyo in 1993, page 98). Accordingly, applying compressive stress on the surface portion of an amorphous alloy in advance is an effective method for preventing a fracture of the amorphous alloy. In the present invention, the compounds made by the infiltration element and an element forming an amorphous alloy are mechanisms for generating surface residual compressive stress. By this stress, the bending strength and the impact stress can be improved.

EXAMPLES NOS. 1–5

Comparative Examples Nos. 1–14

Examples of the alloy according to the present invention defined by claim 1 and its producing method will be explained as follows.

Starting from the materials whose alloy compositions are shown in Table 1 (Example Nos. 1 to 3), amorphous alloy ingots each having a thickness of 3 mm were produced in a water cooling copper die by a pressure casting machine capable of a mold compression by air pressure under the conditions of 3 atmospheric pressure. The tensile strength (σf) and hardness of the ingots were measured by utilizing an Instron tension test machine and a Vickers hardness meter. The impact strength and the bending strength thereof were evaluated in accordance with a Charpy impact test and a three-point bending test.

As comparative examples, amorphous alloy ingots (comparative examples Nos. 1 and 2) were made by a regular non-pressure mold casting machine, and amorphous alloy ingots (comparative examples Nos. 4 to 8) which do not satisfy the mean crystal grain diameter or the crystal volume percentage defined by the claims were made by intentionally increasing or decreasing the cooling rate by a pressure casting machine. In the Table, "dav," "Vf," "σf," "Hv," "Pmax," "δ," and "σb" denote a mean crystal grain diameter, a crystal volume percentage, breaking tensile strength, Vickers hardness, a maximum load in a bending test, a maximum deflection in the bending test and bending strength, respectively.

TABLE 1

| | Alloy Composition | dav (μm) | Vf (%) | σf (MPa) | HV | Impact Strength (kJ/m$^2$) | Bending Test $P_{max}$(N) | δ (mm) | σb(N/mm$^2$) |
|---|---|---|---|---|---|---|---|---|---|
| Example 1 | $Zr_{55}Cu_{30}Al_{10}Ni_5$ | 32 | 31 | 1395 | 485 | 167 | 840 | 2.3 | 3824 |
| Example 2 | $Zr_{55}Cu_{30}Al_{10}Ni_3Co_2$ | 10 | 13 | 1698 | 575 | 165 | 663 | 2.4 | 3212 |
| Example 3 | $Zr_{55}Cu_{29}Al_{10}Ni_5Nb_1$ | 2 | 31 | 1554 | 520 | 167 | 882 | 2.0 | 4263 |
| Comparative Example 1 | $Zr_{55}Cu_{30}Al_{10}Ni_5$ No Pressure | 29 | 35 | 1820 | 590 | 68 | 375 | 2.1 | 1700 |
| Comparative Example 2 | $Zr_{55}Cu_{30}Al_{10}Ni_3Co_2$ No Pressure | 12 | 15 | 1795 | 575 | 70 | 368 | 2.1 | 1720 |
| Comparative Example 3 | $Zr_{55}Cu_{30}Al_{10}Ni_5$ | 30 nm | 1.2 | 1450 | 490 | 69 | 342 | 2.3 | 1483 |
| Comparative Example 4 | $Zr_{55}Cu_{30}Al_{10}Ni_3Co_2$ | 10 nm | 0.8 | 1750 | 565 | 71 | 378 | 2.5 | 1650 |
| Comparative Example 5 | $Zr_{55}Cu_{30}Al_{10}Ni_5$ | 72 | 32 | 1130 | 620 | 51 | 303 | 1.8 | 1172 |
| Comparative Example 6 | $Zr_{55}Cu_{30}Al_{10}Ni_3Co_2$ | 65 | 37 | 1102 | 635 | 58 | 257 | 2.0 | 1100 |
| Comparative Example 7 | $Zr_{55}Cu_{30}Al_{10}Ni_5$ | 36 | 43 | 1160 | 625 | 70 | 369 | 1.9 | 1220 |
| Comparative Example 8 | $Zr_{55}Cu_{30}Al_{10}Ni_3Co_2$ | 41 | 51 | 1095 | 640 | 49 | 260 | 1.8 | 1095 |

As apparent from Table 1, each of the amorphous alloys of embodiments Nos. 1 to 3 has impact strength exceeding 160 kj/m$^2$, bending strength exceeding 3000 MPa and tensile strength of 1350 MPa or more. Thus, by dispersing crystal phase having an appropriate mean crystal grain diameter and crystal volume percentage under pressure, these amorphous alloys have been greatly improved in strength against a bending load and an impact load without deteriorating the tensile strength and hardness inherent in an amorphous alloy.

However, as for the comparative examples Nos. 1 and 2 which were die-cast under no pressure, although the compositions of these alloys were the same as those of the examples Nos. 1 and 2, respectively and these alloys had the crystal grain diameter and the volume percentage defined by the claims, the impact strength and the bending strength thereof were about 70 kj/m$^2$ and about 1700 MPa, respectively, which are not so improved.

As for the comparative examples Nos. 3 and 4, the pressure conditions at the time of casting and the compositions were the same as those of the examples Nos. 1 and 2. The mean crystal grain diameter of these comparative alloys fell within the range defined by the claims by cooling quickly and well without adjusting the cooling rate, however, the crystal volume percentage did not fall within the range defined by the claims. In the comparative examples Nos. 3 and 4, although the tensile strength and the hardness inherent in an amorphous alloy were not deteriorated, the impact value and the bending strength were approximately the same as those of the comparative examples Nos. 1 and 2, and the effects by the fine crystal dispersion were not recognized.

In the comparative examples Nos. 5 and 6, by casting from a temperature higher than the optimum producing conditions in the examples Nos. 1 to 3 to reduce the cooling rate, crystal grains were grown so as to have a mean crystal grain diameter larger than that of 50 μm defined by the claims. Due to the growth of crystal grain, the impact value and the bending strength of the alloys were lower than those of the amorphous single phase materials cast under no pressure (comparative examples Nos. 1 and 2). Accordingly, it is understood that the existence of the large crystal grain exerts harmful influence to the impact value and the bending. strength. Further, the increase of the mean crystal grain diameter causes a great deterioration of the tensile strength inherent in an amorphous alloy.

As for the comparative examples Nos. 7 and 8, the pressure conditions at the time of casting and the compositions were the same as those of the examples Nos. 1 and 2. However, by intentionally decreasing the cooling rate by using a die having a smaller heat capacity, the crystal volume percentage was by more than 40%, which is defined in the claims. The increase of the crystal volume percentage causes not only a great deterioration of the tensile strength inherent in an amorphous alloy but also a decrease of the impact value and the bending strength. As will be apparent from the above, it is understood that the increase of the mean crystal grain diameter and the increase of the crystal volume percentage exert the similar influence and cause a great deterioration of the mechanical characteristics of an amorphous alloy.

Therefore, under an appropriate pressure condition and at an appropriate cooling rate, by producing an amorphous alloy ingot in which fine crystals having the mean crystal grain diameter of from 1 nm to 50 $\mu$m and the volume percentage of 5 to 40% are dispersed, the strength against an impact load and a bending load can be greatly improved without causing a deterioration of the tensile strength inherent in an amorphous alloy.

Next, an example of the alloy according to the present invention recited in claim 2 and its producing method will be explained.

Starting from the materials whose alloy compositions are shown in Table 2 (Example Nos. 4 and 5), amorphous alloy ingots each having a thickness of 3 mm and the mean crystal grain diameter and the crystal volume percentage defined by claim 1 were produced in a water cooling copper die by a pressure casting machine capable of a mold compression by air pressure under the conditions of 3 atmospheric pressure. Thereafter, the ingots were processed by a various surface compressive stress applying methods shown in Table 2 to prepare amorphous alloy materials (example Nos. 4 and 5).

As comparative examples, amorphous single phase alloys (comparative examples Nos. 9 and 10), amorphous alloys (comparative examples Nos. 11 and 12) and amorphous alloy materials (comparative examples Nos. 13 and 14) were prepared. The amorphous single phase alloys (comparative examples Nos. 9 and 10) were made by a normal non-pressure die casting. The amorphous alloys (comparative examples Nos. 11 and 12) were made by a pressure casting apparatus to have the mean crystal grain diameter and the crystal volume percentage defined by claim 1, but were not subjected to a strengthening processing. The amorphous single phase alloys (comparative examples Nos. 13 and 14) were made by applying various surface compressive stress applying methods embodying the strengthening method according to the present invention to amorphous single phase alloys made by a normal non-pressure die casting. The tensile strength ($\sigma$f) and hardness thereof were measured by utilizing an Instron tension test machine and a Vickers hardness meter. The impact strength and the bending strength thereof were evaluated in accordance with a Charpy impact test and a three-point bending test.

As apparent from Table 2, each of the amorphous alloys of embodiments Nos. 4 and 5 has the impact strength exceeding 180 kj/m$^2$, the bending strength exceeding 4000 MPa and the tensile strength of about 1600 MPa. Thus, by the existence of appropriate fine crystals and the subsequent strengthening processing, these amorphous alloys have been greatly improved in strength against a bending load and an impact load without deteriorating the tensile strength inherent in an amorphous alloy.

However, as for the comparative examples Nos. 9 and 10 which were die cast under no pressure, although the compositions of these alloys were the same as those of the examples Nos. 4 and 5, respectively, the impact strength and the bending strength thereof were about 70 kj/m$^2$ and about 1700 MPa, respectively, which are not so improved.

As for the comparative examples Nos. 11 and 12, although the average grain diameter and the volume percentage of the fine crystal were the same as those of the examples Nos. 4 and 5, since the strengthening processing after the production was not performed, the impact value and the bending strength were inferior to those of the comparative examples Nos. 4 and 5. In the comparative examples Nos. 13 and 14, although the amorphous single materials which were die-cast under no pressure conditions were subjected to the strengthening processing, the impact value and the bending strength were about 120 kj/m$^2$ and about 2700 MPa, respectively.

As will be understood from the above, an amorphous alloy can be strengthened against a bending load and an impact load without causing a deterioration of a tensile strength inherent in an amorphous alloy by producing an amorphous alloy ingot in which fine crystals having a mean crystal grain diameter of 1 nm to 50 $\mu$m in a crystal volume percentage of 5 to 40% are dispersed under an appropriate pressure condition and at an appropriate cooling rate, and thereafter, heating the alloy ingot in a gaseous atmosphere and rendering boron, carbon, oxygen, nitrogen or fluorine having a small atomic diameter or executing a diffusion heat processing after the ion implantation so as to execute a strengthening processing.

INDUSTRIAL APPLICABILITY

As explained above, the present invention can provide an amorphous alloy which is excellent in bending strength and impact strength and is reliable as practical structural materials.

TABLE 2

| | Alloy Composition | Producing/Strengthening Method | dav ($\mu$m) | Vf (%) | $\sigma_f$ (MPa) | Hardness (Hv) | Impact Strength (kJ/m$^2$) | Bending Strength (MPa) |
|---|---|---|---|---|---|---|---|---|
| Example 4 | $Zr_{55}Al_{15}Ni_{10}Cu_{20}$ | Fine Crystal/C Ion Implantation | 29 | 36 | 1615 | 905 | 180 | 4850 |
| Example 5 | $Zr_{55}Ti_5Al_{10}Ni_{10}Cu_{20}$ | Fine Crystal/C Ion Implantation | 24 | 31 | 1555 | 880 | 183 | 4832 |
| Comparative Example 9 | $Zr_{55}Al_{15}Ni_{10}Cu_{20}$ | Amorphous/No-strengthen | — | — | 1870 | 505 | 72 | 1780 |
| Comparative Example 10 | $Zr_{55}Ti_5Al_{10}Ni_{10}Cu_{20}$ | Amorphous/No-strengthen | — | — | 1620 | 515 | 75 | 1820 |
| Comparative Example 11 | $Zr_{55}Al_{15}Ni_{10}Cu_{20}$ | Fine Crystal/No-strengthen | 32 | 31 | 1395 | 485 | 167 | 3824 |
| Comparative Example 12 | $Zr_{55}Ti_5Al_{10}Ni_{10}Cu_{20}$ | Fine Crystal/C Ion Implantation | 15 | 22 | 1480 | 510 | 162 | 3763 |
| Comparative Example 13 | $Zr_{55}Al_{15}Ni_{10}Cu_{20}$ | Amorphous/C Ion Implantation | — | — | 1630 | 900 | 122 | 2720 |
| Comparative Example 14 | $Zr_{55}Ti_5Al_{10}Ni_{10}Cu_{20}$ | Amorphous/C Ion Implantation | — | — | 1620 | 880 | 115 | 2680 |

What is claimed is:

1. A method for producing an amorphous alloy, comprising the steps of:

pressure-solidifying a molten alloy having a amorphous forming ability under a pressure exceeding one atmospheric pressure to eliminate casting defects so as to form an ingot with a thickness of 2 mm to 10 mm;

adjusting a cooling rate 20 to 50% less than the critical cooling rate of the alloy during the solidification to disperse fine crystals having a mean crystal grain diameter of 2 $\mu$m to 50 $\mu$m and a volume percentage of 10 to 40% and not to precipitate large metallic compounds in an amorphous alloy ingot, to thereby impart a uniform residual compressive stress in the amorphous alloy ingot;

heating the amorphous alloy ingot at a constant temperature rising rate; and infiltrating at least one of boron, carbon, oxygen, nitrogen and fluorine from the surface of the amorphous alloy ingot in a supercooled liquid state before crystallization, to thereby precipitate a high melting point compound thereof with an element forming the amorphous alloy within the alloy ingot for generating surface residual compressive stress so as to strengthen the alloy.

2. The method for producing an amorphous alloy as recited in claim 1, wherein the mean crystal grain diameter is 2 $\mu$m to 32 $\mu$m.

3. The method for producing an amorphous alloy as recited in claim 1, wherein the mean crystal grain diameter is 10 $\mu$m to 32 $\mu$m.

* * * * *